United States Patent [19]

Gherardi

[11] Patent Number: 4,840,266

[45] Date of Patent: Jun. 20, 1989

[54] METHOD AND DEVICE FOR CONTROLLING THE VACUUM IN A SUCCESSION OF SUCTION CONVEYORS

[75] Inventor: Gian L. Gherardi, Medicina, Italy

[73] Assignee: Sasib S.p.A., Bologna, Italy

[21] Appl. No.: 174,350

[22] Filed: Mar. 28, 1988

[30] Foreign Application Priority Data

May 15, 1987 [IT] Italy ..... 12488 A/87

[51] Int. Cl.[4] ..... A24C 5/00; B65G 29/00

[52] U.S. Cl. ..... 198/471.1; 131/94; 131/84.3; 198/803.5

[58] Field of Search ..... 131/94, 84.3; 198/803.5, 471.1

[56] References Cited

U.S. PATENT DOCUMENTS

| | | | |
|---|---|---|---|
| 3,420,243 | 1/1969 | McArthur | 131/94 |
| 3,757,926 | 9/1973 | Gendron et al. | 198/803.5 X |
| 3,901,373 | 8/1975 | Rudziuat | 198/471.1 |
| 4,235,330 | 11/1980 | Zausch et al. | 198/803.5 X |
| 4,508,207 | 4/1985 | Oberdorf | 198/471.1 |
| 4,693,359 | 9/1987 | Mattei et al. | 198/471.1 X |

*Primary Examiner*—V. Millin
*Assistant Examiner*—Joe H. Cheng
*Attorney, Agent, or Firm*—Larson and Taylor

[57] ABSTRACT

This invention relates to a method and a device for controlling the vacuum in a succession of suction endless conveyors (1 to 6) connected to a single vacuum generator (17), particularly in the machines and plants of the tobacco industry. According to the invention, upon starting, the successive suction conveyors (1 to 6) are connected to the vacuum generator (17) either individually or in groups, by successive steps and progressively in the advance direction (F) of the flow of articles being conveyed. This is accomplished by use of a suitable distributor (18, 118, 24) controlled by a device (21) responsive to the advance of the leading end of the flow of articles being conveyed.

5 Claims, 4 Drawing Sheets

1
2
3
4
5
6
T1
T2
T3
T4
T5
T6
16
17
18
19
21
22
F

METHOD AND DEVICE FOR CONTROLLING THE VACUUM IN A SUCCESSION OF SUCTION CONVEYORS

SUMMARY OF THE INVENTION

The invention relates to the machines and plants comprising a succession of suction conveyors connected to a single vacuum generator.

More particularly, the invention relates to machines and plants of the tobacco industry. Such machines or plants comprise a plurality of successive fluted endless conveyors formed, for example, by rotary drums intended to convey cigarettes and/or filter tips, or the like, accommodated either individually or in groups in the flutes of the conveyors. These cigarettes are held therein by the action of vacuum exerted through suction holes formed in the bottom of said flutes and connectible during a fraction of a complete revolution of the respective conveyor and through an associated suction chamber, to a common vacuum generator.

In a succession of suction conveyors of the type mentioned above, the vacuum generator is of such dimensions whereby its air flowrate causes a sufficient suction only when a considerable part of the suction holes of all the conveyors is covered and closed by the articles being conveyed. Thus, initially (i.e. upon starting the machine or the plant), when all the suction holes of the conveyors are opened and freely communicating with the atmosphere, it is difficult to hold the articles to be conveyed on said conveyors. This is especially a problem when the conveyors are constituted by rotary drums which impart a centrifugal force to the articles being conveyed.

Therefore, in the previously known embodiments, the vacuum generator is made oversize or an auxiliary generator is used which is activated only initially and is disactivated during the normal operation. Both these artificies are entieconomical. Alternatively, the machine or the plant may be operated initially at reduced speed to reduce the mass-dependent forces and particularly the centrifugal forces acting on the articles being conveyed. However, this method involves loss of time and may even cause more extensive scraps.

The invention aims to overcome these disadvantages and permit a speedy and reliable starting of the machines and plants of the type described in the preamble. This is accomplished with a single vacuum generator which is sized for the normal running of the plurality of suction conveyors.

This problem is solved by the invention in that, upon starting the machine or the plant, the successive suction conveyors are connected to the vacuum generator either individually or in groups. This is done by successive steps and progressively in the advance direction of the flow of the articles being conveyed, each time just before these articles reach the next conveyor or group of conveyors which need to be connected to the vacuum generator.

According to the invention, therefore, upon starting the machine or the plant, the single vacuum generator is connected initially only to the first suction conveyor or only to a first group of suction conveyors (with respect to the direction of conveyance of the article). Thereafter, the vacuum generator is sequentially connected to the successive suction conveyors(s) or groups of suction conveyors, just before the flow of articles conveyed by the preceding conveyor(s) or groups of conveyors reach the next suction conveyor or the next group of suction conveyors. Thus, even in the starting step of the machine or the plant, the vacuum generator unit is connected only to a limited number of suction holes that are uncovered and freely communicating with the atmosphere. Thus, the single vacuum generator may be sized for the normal running of the machine, and the startng of the machine or the plant may be effected at normal speed.

BRIEF DESCRIPTION OF THE DRAWINGS

The method according to the invention may be carried into effect by any suitable devices, some embodiments of which will be described hereinafter, by way of non-limiting examples with reference to the accompanying drawings, wherein.

DESCRIPTION OF THE PREFERRED EMBODIMENTS

Figure 1:
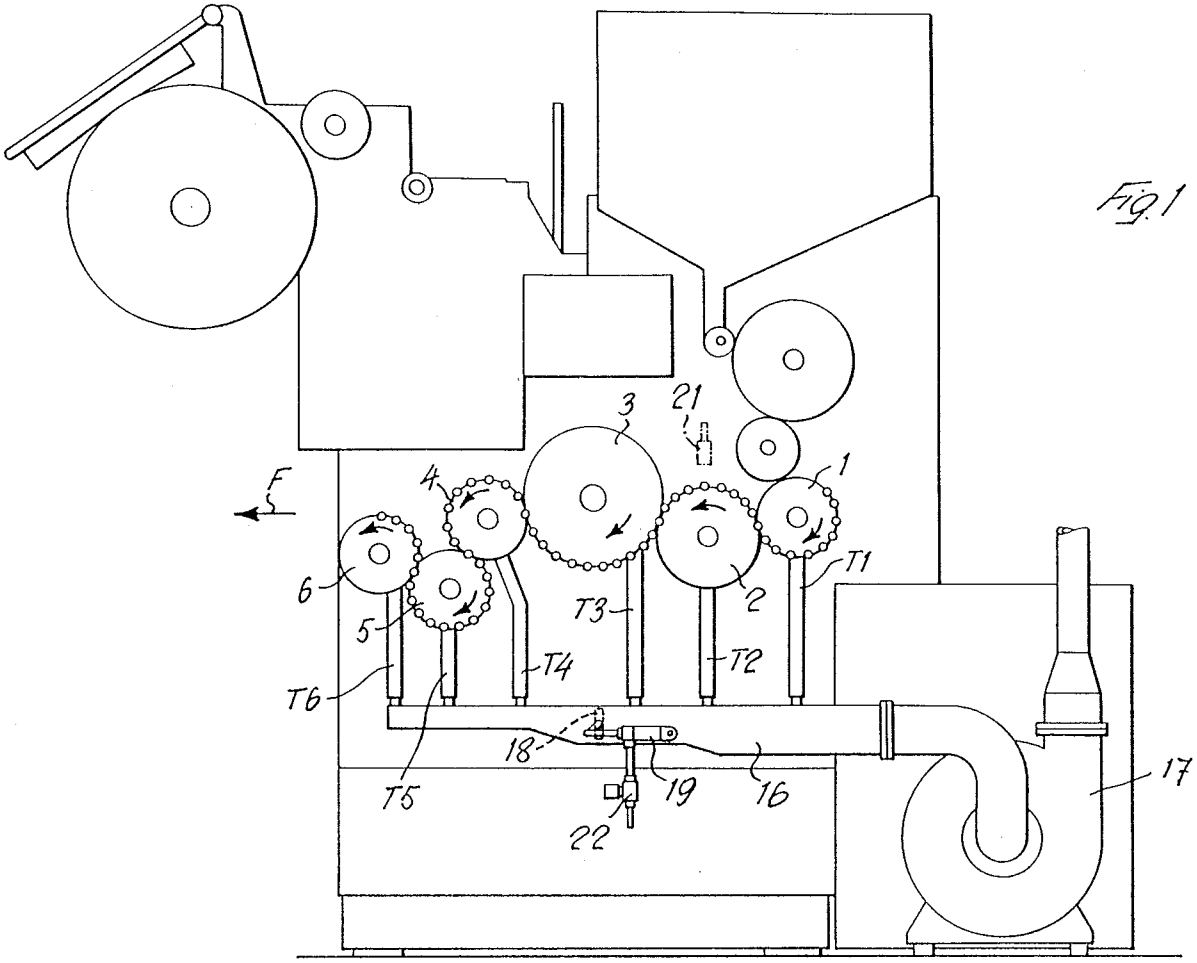
FIG. 1 shows diagrammatically the succession of fluted suction conveyor drums of a machine for applying filter tips to cigarettes, the suction of the drums being controlled in the starting step according to the method of the invention.

The machine for applying filter tips to cigarettes, shown in FIG. 1, is known per se and, therefore, will be only described briefly. It comprises a succession of suction endless conveyors constituted by conveyor drums 1, 2, 3, 4, 5 and 6 which rotate in the directions of the arrows and are formed with peripheral longitudinal suction flutes. The drum 1 carries in the flutes thereof groups formed, each, by two cigarettes with an interposed double-length filter tip, said cigarettes and filter being not in contact with each other. These groups are transferred from the drum 1 into the flutes of the drum 2, where the two cigarettes of each group are brought into contact with the interposed filter. The groups are then transferred to the drum 3, where the two cigarettes of each group are connected to the interposed double filter by means of a strip of covering material which is wrapped around the double filter and adjacent ends of the two cigarettes. The thus assembled groups are then transferred onto the drum 4, where each group is cut intermediately through the double filter, thus obtaining two filter-tipped cigarettes arranged in two side-by-side rows, the cigarettes of the two rows having their filters facing to one another. One of these rows of cigarettes is tranferred onto a drum 5 associated with an inverter device (not shown) which rotates the individual cigarettes 180° about a central transverse axis. The row of the thus inverted cigarettes is transferred from the drum 5 to the drum 6 which receives as well the other row of non-inverted cigarettes either directly from the drum 4 or by means of an intermediate drum (not shown). These non-inverted cigarettes are laid down between the inverted cigarettes from the drum 5, whereby a single row of filter-tipped cigarettes having the same orientation will be formed on the drum 6. Cigarettes, filters and filter-tipped cigarettes, therefore, are conveyed by the fluted suction drums 1 to 6 in the direction of the arrow F of FIG. 1.

Figure 3:
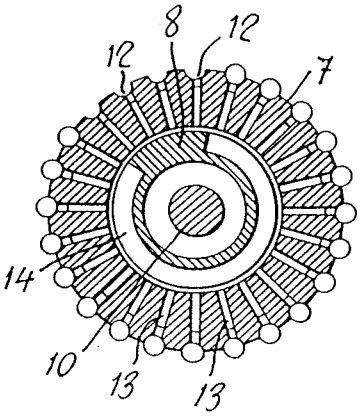
FIG. 3 is a cross sectional view thereof on the line III—III of FIG. 2.
Figure 2:
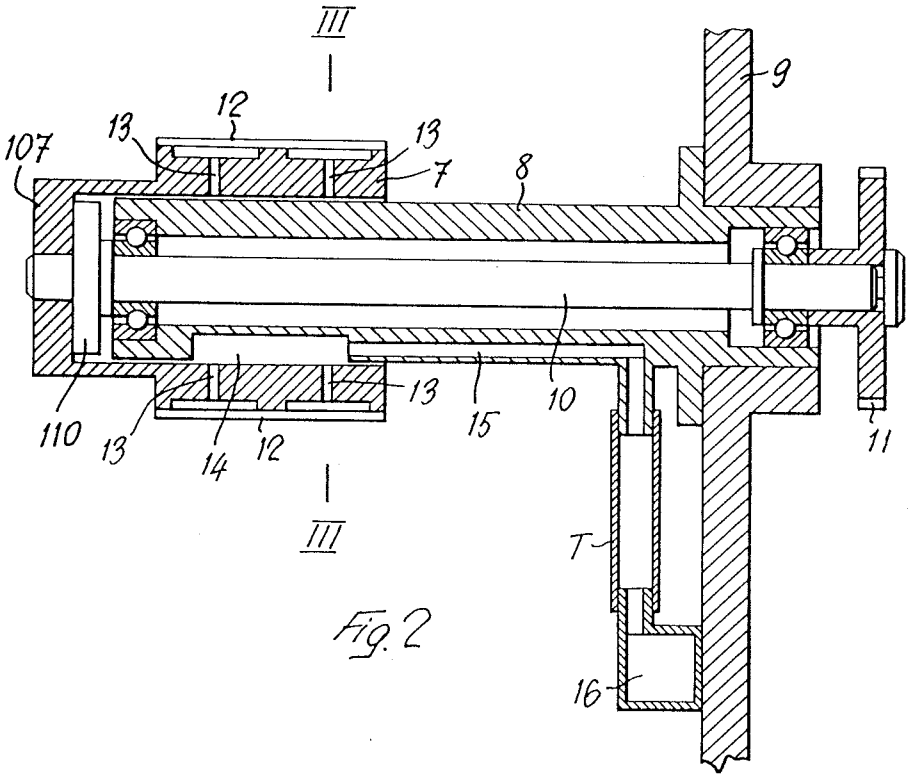
FIG. 2 is a longitudinal sectional view of one of the conveyor drums.

The individual rotary, fluted, sucking conveyor drums 1 to 6 may be constructed in several ways, for example one of the known ways. The construction of a possible practical embodiment of the drums 1 to 6 is shown in the FIGS. 2 and 3. According to this embodiment, each of the drums 1 to 6 comprises a tubular cylindrical body 7 which is rotatably and sealingly mounted on a stationary supporting sleeve 8 protruding overhangingly from the frame 9. Rotatably supported within the supporting sleeve 8 is a shaft 10 which is rotated, for example, by means of a gearwheel 11. The tubular body 7 of the drum is connected to the end of the shaft 10 that protrudes from the free end of the supporting sleeve 8. For this purpose, the body 7 of the drum may be cup-shaped and sealingly and rotatably mounted on the end of the supporting sleeve 8 and may be secured with its bottom 107 to an end flange 110 of the shaft 10.

The tubular cylindrical body 7 of the drum is formed peripherally with flutes 12 constituted by longitudinal grooves and each communicating with one or more radial holes 13 opening in the inner circumference of said tubular body 7.

At the radial holes 13 of the body 7 of the drum, the supporting sleeve 8 has an outer recess 14 extending over the angle at which the conveyor drum shall exert its sucking action to hold the cigarettes and/or filters in the flutes 12. This recess 14 forms a suction chamber to which the holes 13 in the flutes are brought into communication when the body 7 of the drum is rotated. The suction chamber 14 communicates with a suction conduit 15 formed in the thickness of the wall of the stationary supporting sleeve 8. The suction conduit 15 and, therefore, the suction chamber 14 of each drum 1 to 6 are connected, each through at least one tube T1 to T6 and through a suction manifold 16, to a vacuum generator constituted, for example, by an aspirator 17.

The suction manifold 16 is closed at the end thereof opposite to the end connected to the aspirator 17 and its cross section is progressively reduced, either continuously or by steps, from the aspirator toward the closed end.

Figure 5:
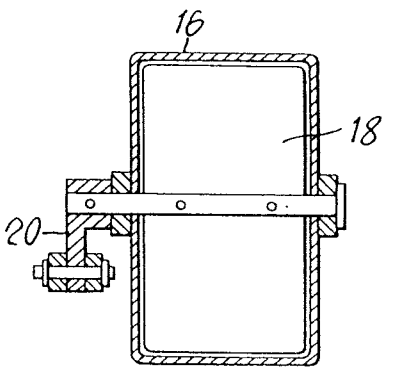
FIG. 5 is a cross sectional view of the butterfly valve, on the line V—V of FIG. 4.
Figure 4:
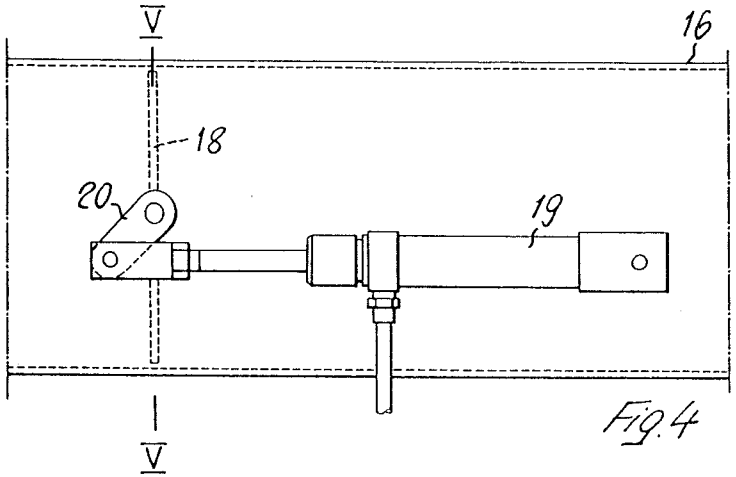
FIG. 4 is an elevational view and on an enlarged scale, of the butterfly valve provided in the suction manifold which is connected to the conveyor drums of FIG. 1.
Figure 6:
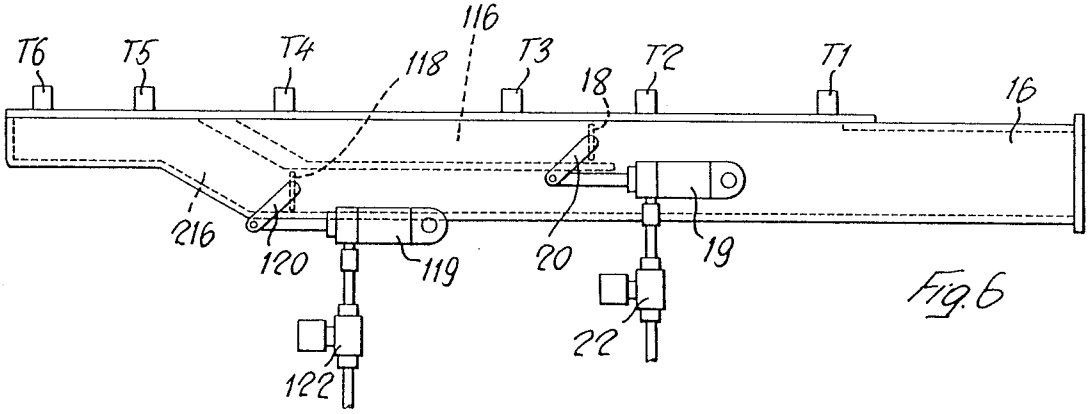
FIG. 6 is an elevational view of the suction manifold of a modified embodiment of the device of FIG. 1.

Arranged in the suction manifold 16 is a butterfly valve 18 controlled by a pneumatic cylinder 19 by means of a small lever 20 (see FIGS. 4–6). Said butterfly valve 18 is disposed so as to divide the suction manifold 16 into two successive sections, namely a first section connected to the aspirator 17 and—through the tubes T1, T2, T3—to the conveyor drums 1, 2, 3, and a second closed section which is closed at the end thereof and is connected to the conveyor drums 4, 5 and 6 through the respective tubes T4, T5 and T6. Upon starting the machine, when all the flutes 12 of all the conveyor drums are free and the respective suction holes 13 are uncovered and in communication with the atmosphere, the butterfly valve 18 is in its closed position, as shown in the FIGS. 1, 4 and 5.

The vacuum generated by the aspirator 17, therefore, is only exerted in the first section of the manifold 16 and therefore, through the tubes T1, T2 and T3, only in the suction chambers 14 of the first three conveyor drums 1, 2 and 3. When the flow of articles, i.e. of the assemblies constituted by a pair of cigarettes with an interposed double-length filter, is about to reach the conveyor drum 4, that is when all the suction holes 12 of the first two conveyor drums 1 and 2 and some of the suction holes of the conveyor drum 3 have been closed, the butterfly valve 18 is opened, whereby the vacuum generated by the aspirator 17 is also exerted in the second section of the manifold 16 and, therefore, through the tubes T4, T5 and T6, in the suction chamber 14 of the successive three conveyor drums 4, 5 and 6.

The opening of the valve 18 is controlled automatically by means of any suitable device which is responsive, upon starting the machine, to the advancing movement of the flow of articles on the first drums 1, 2, 3. For this purpose, for example, any device known per se may be used to count the steps made by the article, i.e. the assembly formed by a pair of cigarettes and interposed double-length filter, which is fed to the first conveyor drum 1. When the number of steps which have been counted reaches a given value corresponding to a desired position reached by the leading end of the flow of articles on the conveyor drum 3, said counting device causes the opening of the solenoid valve 22 that feeds pressurized air to the pneumatic cylinder 19 and thus causes the opening of the butterfly valve 18 in the suction manifold 16.

As an alternative, a photocell 21 may be provided, which is shown with dot-and-dash lines in FIG. 1 and is responsive to the passage of the leading end of the flow of articles on the drum 2 or the durm 3, said photocell 21 causing the opening of the solenoid valve 22 which feeds the pneumatic cylinder 19 so as to open the butterfly valve 18.

In the modified embodiment of FIG. 6, the suction manifold 16 comprises a first section connected through the tubes T1, T2 to the first two conveyor drums 1, 2. Connected in parallel to said first section, each through a butterfly valve 18, 118, are two successive sections or branches 116, 216 of the suction manifold, one section 116 of which is connected through the tubes T3, T4 to the suction chambers 14 of the two drums 3 and 4, while the other section 216 is connected through the tubes T5, T6 to the suction chambers 14 of the last two conveyor drums 5, 6. When the machine is started, both butterfly valves 18, 118 are closed whereby the suction is exerted only in the first two conveyor drums 1, 2.

Successively, as a function of the advance of the flow of articles being transported, the butterfly valve 18 is first opened by means of the lever 20 and pneumatic cylinder 19 under the control of the solenoid valve 22, and the butterfly valve 118 is thereafter opened by means of the lever 120 and pneumatic cylinder 119 under the control of the solenoid valve 122. Thus, when the machine is started, the suction is connected first to the conveyor drums 1 and 2, then to the conveyor drums 3 and 4, and finally to the conveyor drums 5 and 6.

Figure 7:
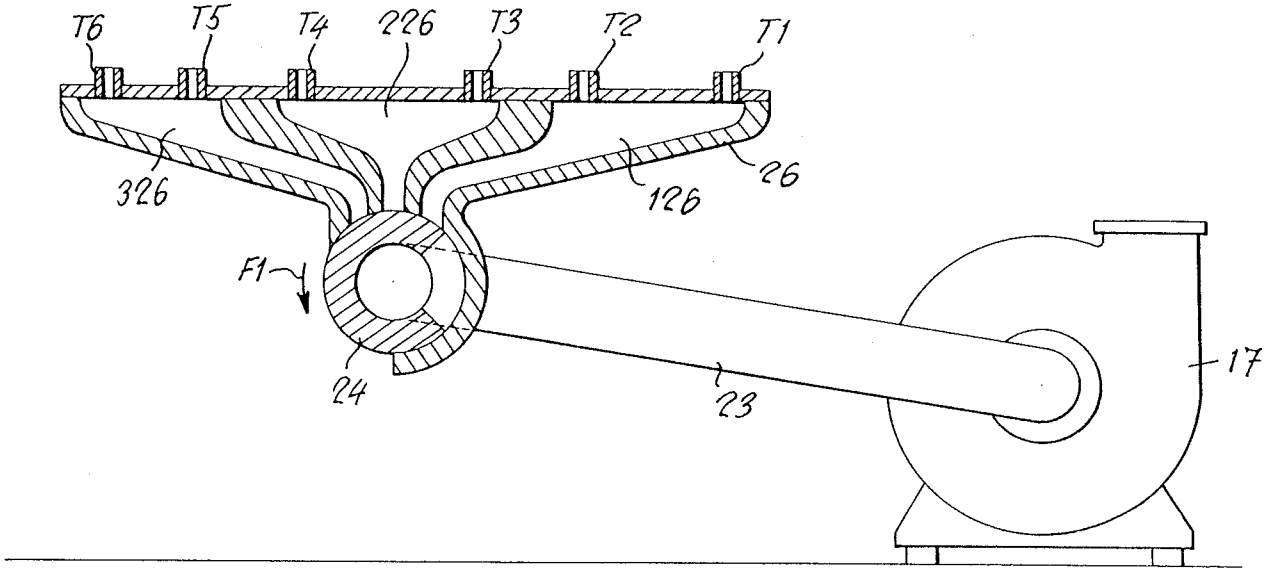
FIG. 7 is a longitudinal vertical sectional view of a further modified embodiment of the suction manifold and the valve for connecting it to the vacuum generator.

In the embodiment according to FIG. 7, there is provided a suction manifold 26 which is divided into three chambers 126, 226 and 326 each connected to the suction chambers 14 of two conveyor drums 1-2, 3-4 and 5-6 through the respective tubes T1-T2, T3-T4 and T5-T6.

This suction manifold is connected to the vacuum generator, i.e. to the aspirator 17, through a conduit 23 and a rotary valve 24 shown very diagrammatically. Upon starting, this valve 24, by rotating in the direction of the arrow F1, connects the chambers 126, 226, 326 of the suction manifold and, therefore, the suction chambers 14 of the pairs of conveyor drums 1-2, 3-4, and 5-6, after each other, to the aspirator 17, depending upon the advance of the flow of articles over the successive conveyor drums 1 to 6.

Of course, the invention is not limited to the embodiments described and shown herein, but broad changes and modifications especially of constructional nature, may be made thereto, and it may be applied to other machines and plants comprising two or more successive suction conveyors affected by equal or similar problems as those described at the beginning. More particularly, the suction conveyors may be constituted as well by endless belts or chains and they may be or may not be provided with flutes. Upon starting, instead of connecting to the vacuum generator, after each other, groups of two or more suction conveyors, as in the illustrated embodiments, single suction conveyors may be connected after each other to the vacuum generator.

I claim:

1. An apparatus for conveying articles comprising:

a succession of endless conveyors, the articles being individually held by suction on one said conveyor and then transferred to a succeeding said conveyor, each said conveyor including suction holes and a suction chamber to which said suction holes are successively connected for a predetermined fraction of a cyclic movement of said conveyor to hold the article to said conveyor during that fraction of movement; and a vacuum generating means for generating a vacuum for each of said suction chambers and including a distributor means for distributing the vacuum to each said suction chamber and a control means for sensing a leading end of a flow of the articles upon a starting of the conveying of the articles and for connecting at least one said suction chamber through said distributor means to said vacuum generating means by a successive step and progressively just in advance of a receipt by the associated said at least one said conveyor of the leading end of the flow of the articles.

2. An apparatus for conveying articles as claimed in claim 1 wherein said conveyors each include a rotary drum having a plurality of flutes in a periphery thereof for individually receiving a respective one of the articles, with each said flute including therein at least one said suction hole which said suction hole is directed inwardly of said drum, and wherein said suction chamber of each conveyor is located inside of an associated said rotary drum.

3. An apparatus for conveying articles as claimed in claim 1 wherein said distributor means includes a suction manifold which is connected at one end to said vacuum generating means and which is split into at least an upstream branch and a downstream branch in series with each other at the other end with each said branch connected to at least one said suction chamber; and wherein said control means includes a stop valve in said upstream branch.

4. An apparatus for conveying articles as claimed in claim 1 wherein said distributor means includes a suction manifold which is connected at one end to said vacuum generating means and which is split into at least two branches in parallel with each other at the other end with each said branch connected to at least one said suction chamber; and wherein said control means includes a stop valve in each of said branches.

5. An apparatus for conveying articles as claimed in claim 1 wherein said distributor means includes a suction manifold which is connected at one end to said vacuum generating means and which split into at least two manifold chambers at the other end with each said manifold chamber connected to at least one said suction chamber; and wherein said control means includes a rotary valve means disposed in said manifold for connecting each said manifold chamber one after the other to said one end of said suction manifold.

* * * * *